US006260239B1

(12) United States Patent
Rübenach

(10) Patent No.: US 6,260,239 B1
(45) Date of Patent: Jul. 17, 2001

(54) FIBER LAP PRODUCING APPARATUS HAVING A FEED CHUTE OF RECTANGULAR CROSS SECTION

(75) Inventor: Bernhard Rübenach, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 09/575,527

(22) Filed: May 22, 2000

(30) Foreign Application Priority Data

May 21, 1999 (DE) ..... 199 23 418

(51) Int. Cl.[7] ..... D01B 1/00

(52) U.S. Cl. ..... 19/97.5; 19/105; 19/200; 19/204; 19/205

(58) Field of Search ..... 19/65 R, 97.5, 19/98, 100, 101, 105, 200, 202, 203, 204, 205

(56) References Cited

U.S. PATENT DOCUMENTS 4,520,531 6/1985 Hergeth .
4,939,815 7/1990 Leifeld .

FOREIGN PATENT DOCUMENTS 33 15 909 11/1984 (DE) .
34 13 595 10/1985 (DE) .
85 34 080 5/1987 (DE) .
87 13 681 3/1989 (DE) .
33 28 358 1/1993 (DE) .

OTHER PUBLICATIONS

Wiegel, "Einfluss der Flockenspeisung auf die Bandgleichmässigkeit", textil praxis International, Oct. 1975, vol. 30, No. 10, pp. 1387–1391.

*Primary Examiner*—John J. Calvert
*Assistant Examiner*—Gary L. Welch
(74) *Attorney, Agent, or Firm*—Venable; Gabor J. Kelemen

(57) ABSTRACT

An apparatus for making a fiber lap from a mass of fiber tufts includes a generally vertically extending feed chute having relatively wide first and second walls facing one another and relatively narrow third and fourth walls facing one another. The distance between the third and fourth walls defines the width of the feed chute. Each first and second wall has a mid region and flanking edge regions. The first and/or second wall is provided with air outlet openings in a bottom region. The apparatus further has a device for charging the feed chute with fiber tufts at a top portion thereof, and a device for withdrawing the fiber tufts from the feed chute as a fiber lap at a bottom portion of the feed chute. A plurality of side-by-side arranged elements are positioned in a series on the first wall at a bottom portion thereof along the wall width. The distance between any given element and the second wall defines the depth of the feed chute at the given element. The elements in the mid region have a first dimension measured parallel to the wall width, and the elements in the edge regions have a second dimension measured parallel to the wall width. The first dimension is greater than the second dimension, and the elements in the mid region are at a greater distance from the second wall than the elements in the edge regions of the first wall.

16 Claims, 4 Drawing Sheets

Fig. 5 (A) PRIOR ART
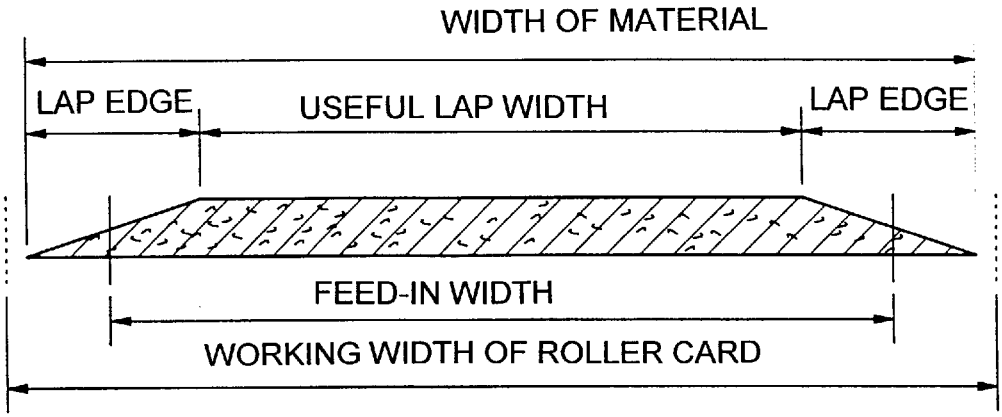
Fig. 5 (B) PRIOR ART
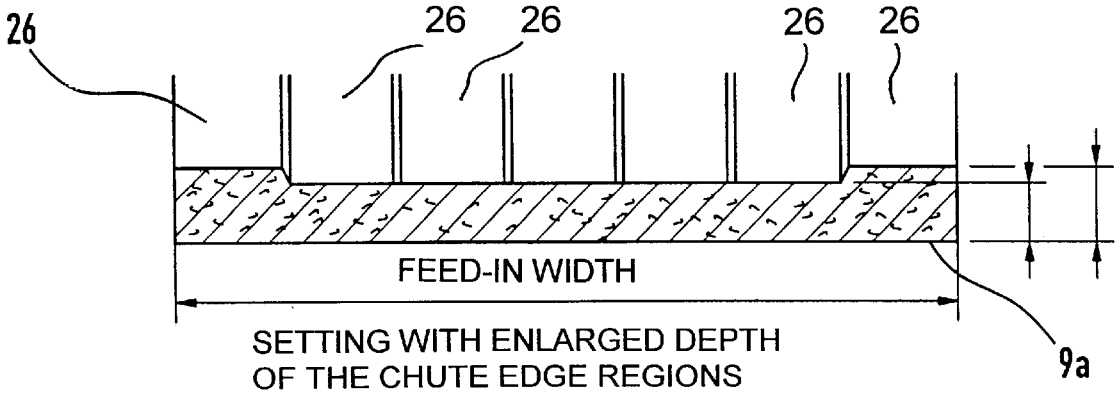
Fig. 5 (C) PRIOR ART
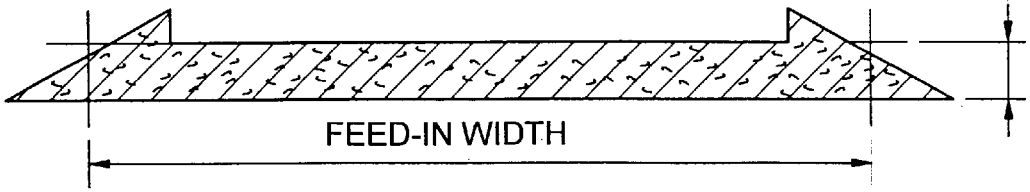

Fig. 6 (A)
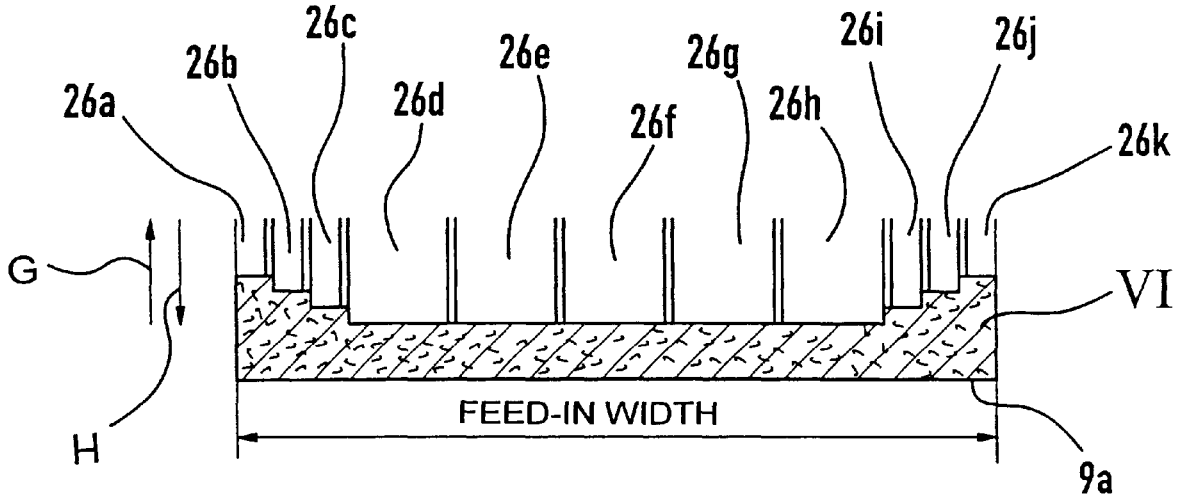
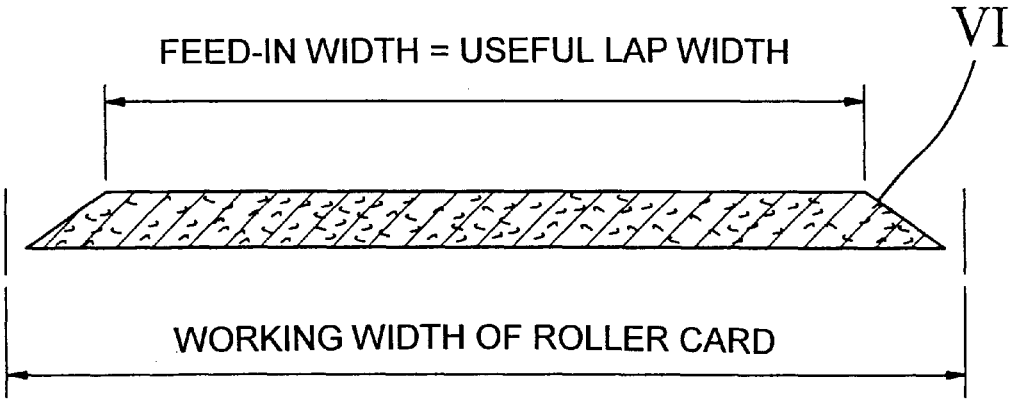
Fig. 6 (B)

FIBER LAP PRODUCING APPARATUS HAVING A FEED CHUTE OF RECTANGULAR CROSS SECTION

CROSS REFERENCE TO RELATED APPLICATION

This application claims the priority of German Application No. 199 23 418.3 filed May 21, 1999, which is incorporated herein by reference.

BACKGROUND OF THE INVENTION

This invention relates to an apparatus for producing a fiber lap from fiber tufts and is of the type which has a substantially vertical chute (feed chute) of rectangular cross section. The chute has two facing wide vertical walls and two facing narrow vertical walls as well as a width dimension which is the horizontal distance between the two narrow vertical walls. The upper end of the chute is provided with a fiber tuft supplying device, while its lower end accommodates a device for withdrawing the fiber tufts and discharging them as a fiber lap. One of the wide walls of the chute is air pervious and has, along the chute width, a plurality of side-by-side arranged elements for varying the air flow in the chute at those locations.

As disclosed in German Offenlegungsschrift (application published without examination) 34 13 595, a series of parallelepiped-shaped bodies of identical width are arranged in an opening which is provided in a chute wall facing the air pervious chute wall and which extends along the width of the feed chute. Each body is horizontally shiftable by an electromagnet so that the cross section of the feed chute is variable at those locations, whereby the air flow may be altered. The electromagnets are coupled to a control device. The opposite end regions (edge zones) of the chute wall, as viewed along its width, are covered by a relatively wide body. A carding machine is arranged immediately downstream of the feed chute for receiving the fiber lap therefrom. As a rule, the fiber lap has a width of 1 m.

Particularly in roller card units which have a width of 2.50 m or more, a spreading of the fibers in the edge zones occurs. At the output of the roller card unit such a spread leads to a reduction of the desired weight at the edge regions of the web (edge regions of the delivered fiber lap) and thus necessarily leads to a reduction of the useful output width. Further, the excessively light web edges lead to a more pronounced soiling of the machine at the roll ends which requires a more frequent servicing (maintenance work) of the machine.

SUMMARY OF THE INVENTION

It is an object of the invention to provide an improved apparatus of the above-outlined type from the discussed disadvantages are eliminated and which, in particular, provides for an increase in the useful width of the fiber web and a reduction of the waste at the edge regions.

These objects and others to become apparent as the specification progresses, are accomplished by the invention, according to which, briefly stated, the apparatus for making a fiber lap from a mass of fiber tufts includes a generally vertically extending feed chute having relatively wide first and second walls facing one another and relatively narrow third and fourth walls facing one another. The distance between the third and fourth walls defines the width of the feed chute. Each first and second wall has a mid region and flanking edge regions. The first and/or second wall is provided with air outlet openings in a bottom wall region. The apparatus further has a device for charging the feed chute with fiber tufts at a top portion thereof, and a device for withdrawing the fiber tufts from the feed chute as a fiber lap at a bottom portion of the feed chute. A plurality of side-by-side arranged elements are positioned in a series on the first wall at a bottom portion thereof along the wall width. The distance between any given element and the second wall defines the depth of the feed chute at the given element. The elements in the mid region have a first dimension measured parallel to the wall width, and the elements in the edge regions have a second dimension measured parallel to the wall width. The first dimension is greater than the second dimension, and the elements in the mid region are at a greater distance from the second wall than the elements in the edge regions of the first wall.

By virtue of the measures according to the invention, a preservation of the desired weight at the edge regions of the fiber web (the edge regions of the delivered fiber lap), an increase of the useful width, a reduction of the soiling of the machine and a reduction of the maintenance frequency of the machine are ensured. The resulting web profile (the profile of the delivered fiber lap) advantageously provides for a combination of a feed-in width (which reduces edge soiling) with a possibly large delivery width of the web output of the roller card unit wherein the desired weight tolerances are observed and a weight increase in the edge regions is safely avoided.

The invention has the following additional advantageous features:

- In the lateral regions of the feed chute a plurality of segments is provided; in the mid zone the segments are approximately 250–350 mm wide, while in the lateral regions their width is approximately 50–150 mm.
- The elements are side-by-side arranged cover plates of an air pervious wall of the chute; the cover plates extend parallel to the chute width.
- The elements are independently movable segments having air outlet openings.
- Each segment forms a pivotally supported chute wall portion movable generally parallel to the depth dimension of the chute.
- The wall elements are provided in the chute zone where the fiber lap is formed from the tufts, and each wall element is movable by a setting device.
- A plurality of measuring members are provided to determine the density of the fiber lap along the width thereof.
- The measuring members are connected with element-operating setting members via a regulating and control apparatus.
- The measuring members are situated adjacent the fiber web discharged by the roller card unit or the carding machine.
- Each element has an air pervious portion.
- The chute wall situated opposite the elements is air pervious.
- The fiber lap produced by the apparatus according to the invention is directly fed to an after-connected carding machine or a roller card unit.

BRIEF DESCRIPTION OF THE DRAWINGS

FIGS. 5(A), 5(B) and 5(C) are diagrams illustrating a cross-sectional view of a fiber lap produced by a conventional apparatus.

FIGS. 6(A) and 6(B) are diagrams illustrating a cross-sectional view of a fiber lap produced by an apparatus according to the invention.

DESCRIPTION OF THE PREFERRED EMBODIMENTS

Figure 1:
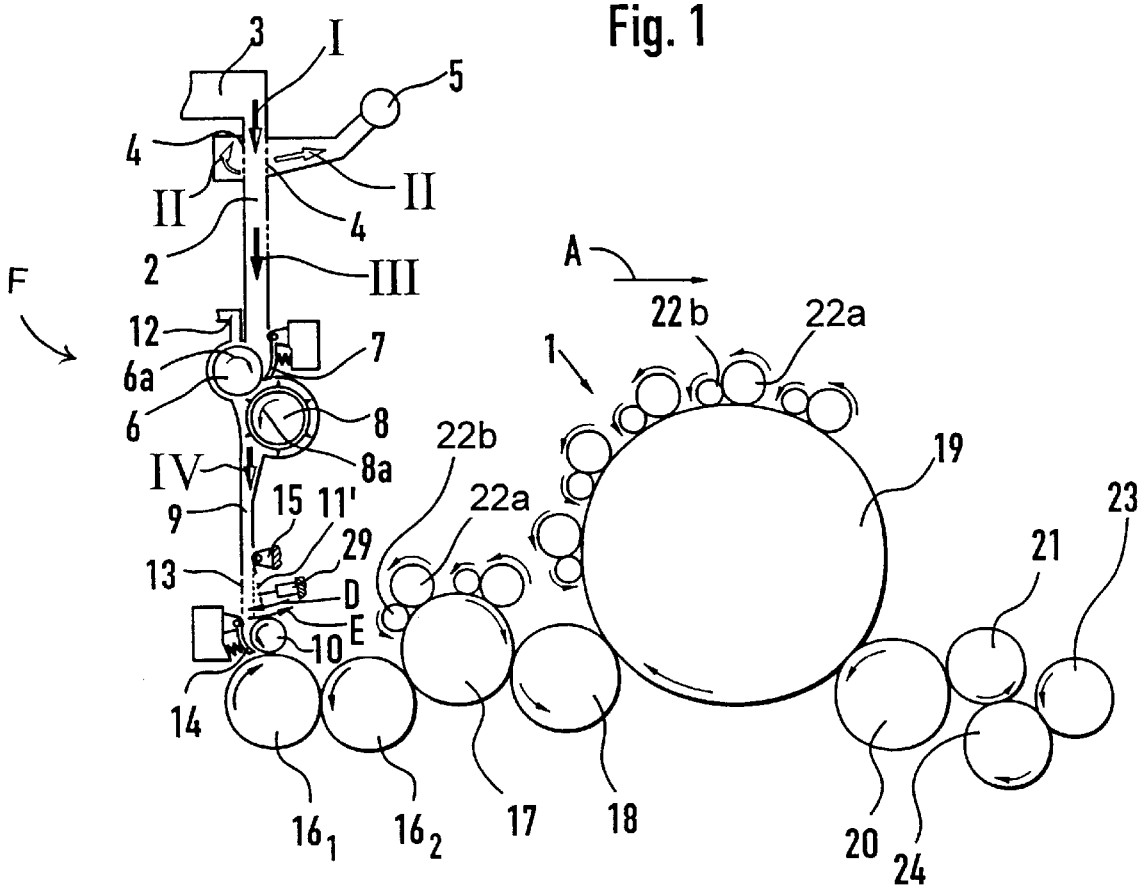
FIG. 1 is schematic sectional side elevational view of a roller card feeder and an after-connected roller card unit incorporating the invention.

Turning to FIG. 1, upstream of a roller card unit 1 a feeder F is positioned, having a vertical reserve chute 2 supplied from above, for example, by a condenser via a supply and distributor duct 3, with a mixture I composed of transport air II and finely opened fiber tufts III. In the upper zone of the reserve chute 2 air outlet openings 4 are provided through which the transport air II enters into a suction device 5 after being separated from the fiber tufts III. The lower end of the reserve chute 2 is obturated by a slowly rotated feed roll 6 which has a rotary direction 6*a* and which cooperates with a feed tray 7. The feed roll 6 advances the fiber tufts III from the reserve chute 2 to a downstream adjoining, rapidly rotated opening roll 8 which is provided with pins or carries a sawtooth wire and which has a circumferential portion facing an upper end of a downwardly extending feed chute 9. The opening roll 8, rotating in the direction of the arrow 8*a*, advances the fiber tufts IV into the feed chute 9. The feed chute 9 has at its lower end a withdrawing roll 10 which pulls the fiber mass from the feed chute 9 and advances the fiber material as a fiber lap to the roller card unit 1. The above-described roller card feeder F may be an EXACTA-FEED model manufactured by Trützschler GmbH & Co. KG, Mönchengladbach, Germany.

Figure 2:
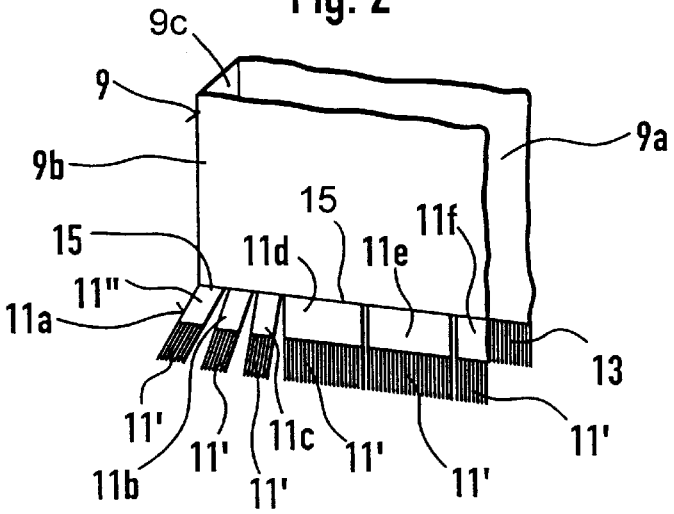
FIG. 2 is a fragmentary perspective view of the feed chute of the feeder, incorporating a preferred embodiment of the invention.
Figure 3:
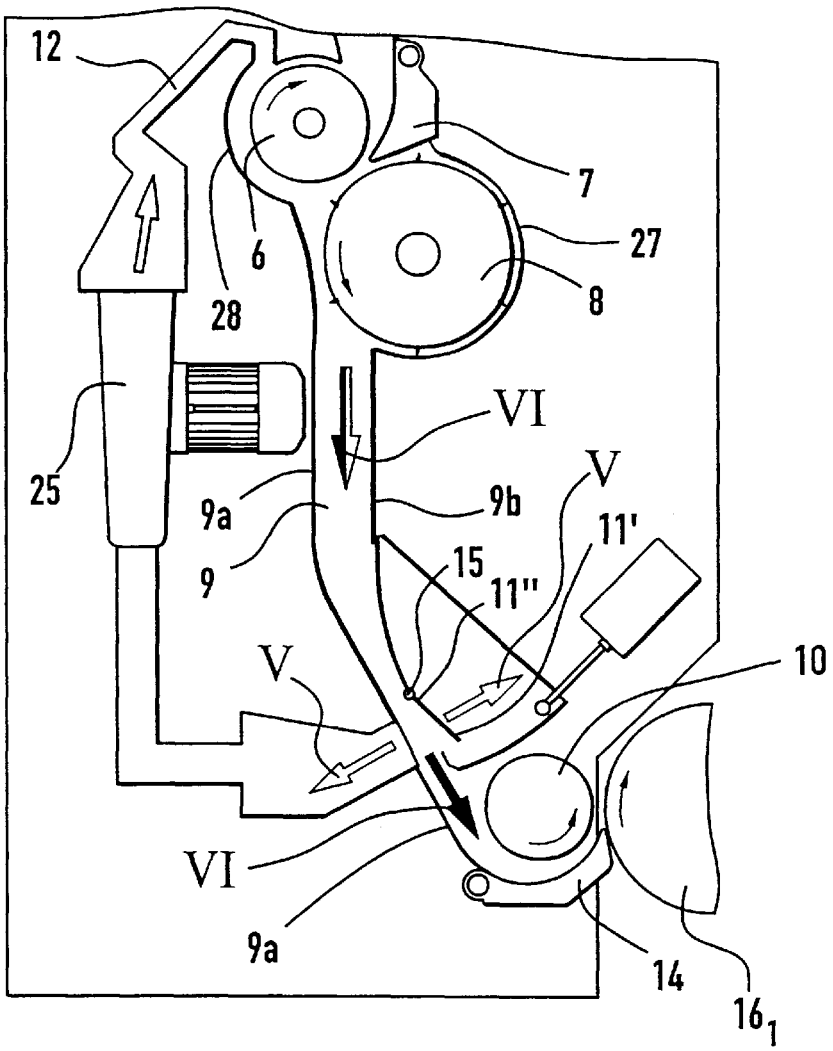
FIG. 3 is a schematic sectional side elevational view of a roller card feeder incorporating the device according to the invention.

Also referring to FIGS. 2 and 3, the generally vertically oriented feed chute 9 is essentially formed of two opposite wide walls 9*a* and 9*b* and two opposite narrow walls 9*c* (only one is visible in FIG. 2). The distance between the narrow walls 9*c* is the width and the distance between the wide walls 9*a* and 9*b* is the depth of the feed chute 9, as defined by the walls 9*a*, 9*b* and 9*c*. At the lower portion of the walls 9*a* and 9*b* respective air outlet openings 11', 13 are provided up to a certain height. At the top the feed chute 9 is communicating with a conduit 12 which is connected to the high-pressure outlet of a blower 25. The rotating feed roll 6 and opening roll 8 continuously introduce fiber tufts III at a certain flow rate into the feed chute 9. The withdrawing roll 10 which cooperates with a feed tray assembly 14 formed of a plurality of feed trays, withdraws the fiber tufts III at the same flow rate from the feed chute 9 and advances the fiber material as a fiber lap to the roller card unit 1.

To uniformly compress (densify) and maintain constant the fiber quantity, the fiber material in the feed chute 9 is exposed to a throughgoing air stream supplied by the blower 25 through the conduit 12. The blower 25 presses air through the fiber mass situated in the feed chute 9 and thereafter the air stream V exits the lower end of the feed chute 9 through the air outlet openings 11', 13 provided therein.

The opening roll 8 is surrounded by a wall face of a housing 27 and the feed roll 6 is surrounded by a wall face of a housing 28; the wall faces conform to the curvature of the rolls 6 and 8, respectively. As viewed in the rotary direction 8*a* of the opening roll 8, the housing 27 is interrupted by a separating opening for the fiber material III. The separating opening is adjoined by a wall region which extends up to the feed roll 6. The feed tray 7 is arranged at the lower end of the wall region situated opposite the feed roll 6. The edge of the feed tray 7 is oriented in the rotary direction 8*a* of the opening roll 8. The plane containing the rotary axes of the feed roll 6 and the opening roll 8 is offset at an angle in the rotary direction of the opening roll 8 with respect to a vertical plane containing the rotary axis of the opening roll 8.

Figure 4:
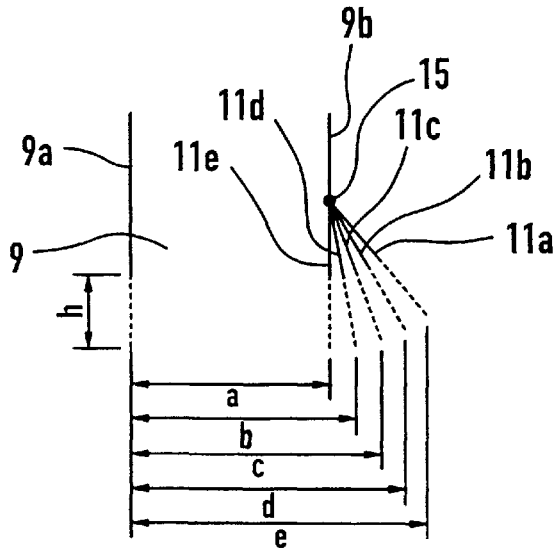
FIG. 4 is a diagrammatic side elevational view of the feed chute showing another preferred embodiment of the invention.

As shown in FIG. 2, the air outlet openings 13 at the lower end of the wall 9*a* are formed by a comb-like construction, whose free tine ends are oriented downwardly. At the lower end of the opposite wall 9*b* a plurality of serially arranged flaps 11*a*–11*n* are provided which are individually pivotally secured to the wall 9*b* by respective hinges 15. The flaps 11*a*–11*n* have unlike widths as viewed in the width direction of the feed chute 9. Thus, the relatively wide flaps 11*d*, 11*e* and 11*f* are situated in the mid region of the chute wall 9*b* and have a width of, for example, 300 mm. Towards both sides in the outward direction, that is, in the lateral regions (edge regions) of the feed chute 9, three flaps 11*a*, 11*b* and 11*c* have a lesser width of, for example, 100 mm. While FIG. 2 shows only the left-side lateral (edge) region of the feed chute 9, it is to be understood that flaps of the same width dimension as flaps 11*a*, 11*b* and 11*c* are provided at the non-illustrated right-hand edge region. The flaps 11*a*–11*n* have each an upper, closed (solid) region 11" adjoining the respective pivot (hinge) 15 and a lower, comb-like region forming the air outlet openings 11'. The height of the air outlet openings 11' in the region of the wall 9*b* is identical to the height of the air outlet openings 13 provided in the wall 9*a*. The densified fiber tuft mass VI is situated in the region of the air outlet openings 11' and 13, and, as shown in FIG. 4, the depth of the feed chute 9 in this region may be adjusted in sections by changing the pivotal position of the flaps 11*a*–11*n*, as indicated by arrows D and E of FIG. 1. The adjustments may be effected by respective pneumatic cylinders 29.

According to FIG. 4, the lower end of the wide flap 11*e* is at a distance a from the wall 9*a*. This distance corresponds to the distance between the walls 9*a* and 9*b*. As viewed in a leftward direction from the flap 11*e*, it is seen that the consecutive flaps 11*d*, 11*c*, 11*b* and 11*a* are pivoted outwardly (in the direction E) to a progressively greater extent, so that their respective distances b, c, d and e from the wall 9*a* are progressively greater than the distance a.

The roller card unit 1 as shown in FIG. 1 has a first preliminary roll $\mathbf{16}_1$ which cooperates with the withdrawing roll 10 of the feeder F, a second preliminary roll $\mathbf{16}_2$, a licker-in 17, a transfer roll 18, a main cylinder 19, a doffer 20 and a stripping roll 21 which removes the fiber material from the doffer 20. The licker-in 17 and the main cylinder 19 cooperate with two and, respectively six roll pairs each being formed of a working roll 22*a* and a reversing roll 22*b*. Two calender rolls 23 and 24 cooperate with the stripping roll 21. The direction of the rotation of the respective rolls is designated by the directional arrows drawn therein.

FIG. 5(A) illustrates the fiber lap cross section at the output of the roller card unit. The reasons for the shown cross-sectional lap configuration are as follows: Upon opening the textile fiber staples in the roller card unit, a spreading of the fibers occurs in the edge zones. Such a spreading leads at the output of the roller card unit 1 to a lesser than desired weight at the lap edges and thus necessarily results in a reduction of the useful delivery width. Further, the excessively light lap edges lead to a greater soiling of the machine at the roll ends, requiring a frequent maintenance of the machine. Conventionally, to counteract such soiling, the fiber lap fed into the roller card unit is maintained at a width which is 100–200 mm less than the working width of the roller card unit. If the depth of the lower portion of the feed chute is simply enlarged to compensate for the tapering of the lap profile in the edge regions and thus the lap weight—which is normally to be held possibly constant over the entire feed-in width—and such an enlargement is effected by increasing the chute depth in the opposite edge regions by segments 26 of identical width, then in the zone of the adjusted (enlarged) chute depth the edge regions of the lap would be excessively thick (and thus too heavy).

According to the invention as illustrated in FIG. 6(A), a series of adjustable segments 26*a* through 26*k* is provided. The segments 26*a*, 26*b*, 26*c* in the left-hand lateral region (edge region) and the segments 26*i*, 26*j*, 26*k* in the right-hand lateral region (edge region) are each narrower than the segments 26*d* through 26*h* in the central region of the feed chute 9. The lap profile obtained with the FIG. 6(A) arrangement is illustrated in FIG. 6(B). Such a lap profile offers the advantage to combine a feeding width which reduces edge soiling with a possibly large discharge width of the output lap, whereby the desired weight tolerance is observed and a weight increase in the edge zone, as shown in FIG. 5(C) is securely avoided. Instead of the pivotal segments 11*a*–11*f* shown in FIG. 2 and representing a first embodiment of the invention, the segments 26*a*–26*k* of FIG. 6(A) representing a second embodiment may be supported in the chute wall 9*b* for linear adjustment in the direction of the arrows G and H.

It will be understood that the above description of the present invention is susceptible to various modifications, changes and adaptations, and the same are intended to be comprehended within the meaning and range of equivalents of the appended claims.

What is claimed is:

1. An apparatus for making a fiber lap from a mass of fiber tufts, comprising (a) a generally vertically extending feed chute having relatively wide first and second walls facing one another and relatively narrow third and fourth walls facing one another; a distance between said third and fourth walls defining a width of said feed chute; each said first and second wall having, as viewed parallel to said width, a mid region and flanking edge regions;

(b) means for charging said feed chute with fiber tufts at a top portion thereof;

(c) means for withdrawing the fiber tufts from said feed chute as a fiber lap at a bottom portion of said feed chute;

(d) means for providing air outlet apertures at a bottom portion of at least one of said first and second walls; and (e) a plurality of side-by-side arranged elements positioned in a series on said first wall at a bottom portion thereof; said series extending along said width; a distance between any given said element and said second wall defining a depth of said feed chute at said given element; said elements in said mid region having a first dimension measured parallel to said width and said elements in said edge regions having a second dimension measured parallel to said width; said first dimension being greater than said second dimension; and said elements in said mid region being at a greater distance from said second wall than said elements in said edge regions of said first wall.

2. The apparatus as defined in claim 1, wherein said edge regions each contain a plurality of said elements.

3. The apparatus as defined in claim 2, wherein the distance of said elements in said edge regions from said second wall progressively increases as viewed in a direction parallel to said width and away from said mid region.

4. The apparatus as defined in claim 1, wherein said dimension of said elements in said mid region is about 250–350 mm.

5. The apparatus as defined in claim 1, wherein said dimension of said elements in said edge region is about 50–150 mm.

6. The apparatus as defined in claim 1, wherein said elements form segments of said first wall.

7. The apparatus as defined in claim 6, further comprising means for pivotally securing each said element to said first wall for individually adjusting the distance of said elements from said second wall.

8. The apparatus as defined in claim 6, wherein said segments have air outlet openings.

9. The apparatus as defined in claim 1, further comprising means for individually adjusting the distance of said elements from said second wall.

10. The apparatus as defined in claim 1, wherein said means for individually adjusting the distance of said elements from said second wall comprises a separate setting device for each element.

11. The apparatus as defined in claim 1, wherein said elements are situated in a region of said means for withdrawing the fiber tufts.

12. The apparatus as defined in claim 1, wherein said second wall is provided with air outlet openings in a region facing said elements.

13. The apparatus as defined in claim 1, wherein said means for charging said feed chute with fiber tufts comprises a reserve chute joined to a top part of said feed chute and a fiber tuft supplying device connected to said reserve chute for introducing fiber tufts thereinto.

14. The apparatus as defined in claim 1, wherein said elements are linearly shiftable parallel to said depth.

15. The apparatus as defined in claim 1, in combination with a roller card unit positioned adjacent said apparatus for receiving the fiber lap therefrom.

16. The apparatus as defined in claim 1, in combination with a carding machine positioned adjacent said apparatus for receiving the fiber lap therefrom.

* * * * *